US007027075B2

(12) United States Patent
Yokoi

(10) Patent No.: US 7,027,075 B2
(45) Date of Patent: Apr. 11, 2006

(54) THERMAL FIXING DEVICE AND IMAGE FORMING DEVICE PROVIDED WITH THE SAME

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/445,839

(22) Filed: May 28, 2003

(65) Prior Publication Data

US 2003/0227533 A1 Dec. 11, 2003

(30) Foreign Application Priority Data

Jun. 10, 2002 (JP) ..... 2002-169176

(51) Int. Cl.
*G03G 15/20* (2006.01)

(52) U.S. Cl. ..... 347/156; 399/328

(58) Field of Classification Search ..... 347/155, 347/156, 212; 399/320, 328, 330–331, 335–338
See application file for complete search history.

(56) References Cited

U.S. PATENT DOCUMENTS

2003/0202826 A1* 10/2003 Yokoi et al. ..... 399/328
2005/0053390 A1* 3/2005 Suzuki et al.

FOREIGN PATENT DOCUMENTS

| | | |
|---|---|---|
| JP | 58-172671 | * 10/1983 |
| JP | A 1-274175 | 11/1989 |
| JP | A 6-118837 | 4/1994 |
| JP | 07-077891 | * 3/1995 |
| JP | A 11-153923 | 6/1999 |
| JP | 2000-227732 | 8/2000 |
| JP | 2001-228735 | 8/2001 |
| JP | 2001-228742 | * 8/2001 |
| JP | 2002-350234 | * 12/2002 |
| JP | A 2003-5574 | 1/2003 |
| JP | A 2003-98866 | 4/2003 |
| JP | A 2003-162177 | 6/2003 |

* cited by examiner

*Primary Examiner*—Huan Tran
(74) *Attorney, Agent, or Firm*—Oliff & Berridge, PLC

(57) ABSTRACT

A thermal fixing device is provided in an image forming device having a main casing. The thermal fixing device includes a thermal fixing unit provided with a heat roller and a pressure roller for heatingly fixing a visible image onto a sheet, and a temperature sensor unit for detecting a temperature of the thermal fixing unit. The temperature sensor unit is mounted to the main casing, and the thermal fixing unit is detachably mounted to the temperature sensor unit.

34 Claims, 5 Drawing Sheets

THERMAL FIXING DEVICE AND IMAGE FORMING DEVICE PROVIDED WITH THE SAME

BACKGROUND OF THE INVENTION

The present invention relates to a thermal fixing device and an image forming device provided with the fixing device.

In an image forming device such as a laser printer, a thermal fixing device including a heat roller and a pressure roller is provided for thermally fixing a toner image onto a sheet. In the thermal fixing device, the toner image which has been transferred onto the sheet is thermally fixed to the sheet when the sheet passes through a nip between the heat roller and the pressure roller.

Generally, the heat roller installs therein a heater such as a halogen lamp, and a temperature sensor is provided for detecting a surface temperature of the heat roller. The fixing temperature can be maintained at a constant temperature by ON/OFF control to the heater based on the detection of the surface temperature by the temperature sensor.

Known as the temperature sensor are a contact type sensor such as a thermistor which is in direct contact with the heat roller and a non-contact type sensor such as an infrared radiation sensor which is out of contact from the heat roller. The non-contact type sensors have been widely used in the thermal fixing device because the heat roller can be protected against injury for a expanded duration due to out of contact from the sensor.

Conventionally, the temperature sensor has been provided in the thermal fixing device together with the heat roller and the pressure roller, because the temperature sensor must be in direct contact with the heat roller in case of the contact type sensor, or must be precisely set and oriented with respect to the heat roller in case of the non-contact type sensor. Therefore, the temperature sensor is attached to or detached from a main casing of the image forming device when the thermal fixing device is replaced by a new thermal fixing device.

In this case, the heat roller and the pressure roller must be frequently replaced by new rollers due to frictional wear as a result of pressure contact with each other, whereas the temperature sensor and particularly the non contact type sensor needs not be replaced frequently, because the latter can provide a prolonged service life because of out of contact from the heat roller. Therefore, in the conventional arrangement, frequent exchange of the thermal fixing device is not economical in terms of the sensor.

SUMMARY OF THE INVENTION

It is an object of the present invention to overcome the above-described problems and to provide an improved thermal fixing device capable of only replacing a thermal fixing unit with a new thermal fixing unit while a temperature sensor unit is still installing in a main casing of an image forming device, thereby avoiding wasteful use of the temperature sensor unit.

Another object of the present invention is to provide an image forming device provided with such improved thermal fixing device. These and other objects of the present invention will be attained by an image forming device including a main casing, and an improved thermal fixing device. The fixing device includes a thermal fixing unit that heatingly fixes a visible image onto an image recording medium and a temperature sensor unit that detects a temperature of the thermal fixing unit. The temperature sensor unit is mounted to the main casing, and the thermal fixing unit is detachably mounted to the main casing.

In another aspect of the invention, there is provided a thermal fixing device including the thermal fixing unit and the temperature sensor unit. The thermal fixing unit is detachably mounted to the temperature sensor unit.

DETAILED DESCRIPTION OF THE PREFERRED EMBODIMENTS

An image forming device according to a first embodiment of the present invention will be described with reference to FIGS. 1 through 6. The embodiment pertains to a laser printer.

Figure 1:
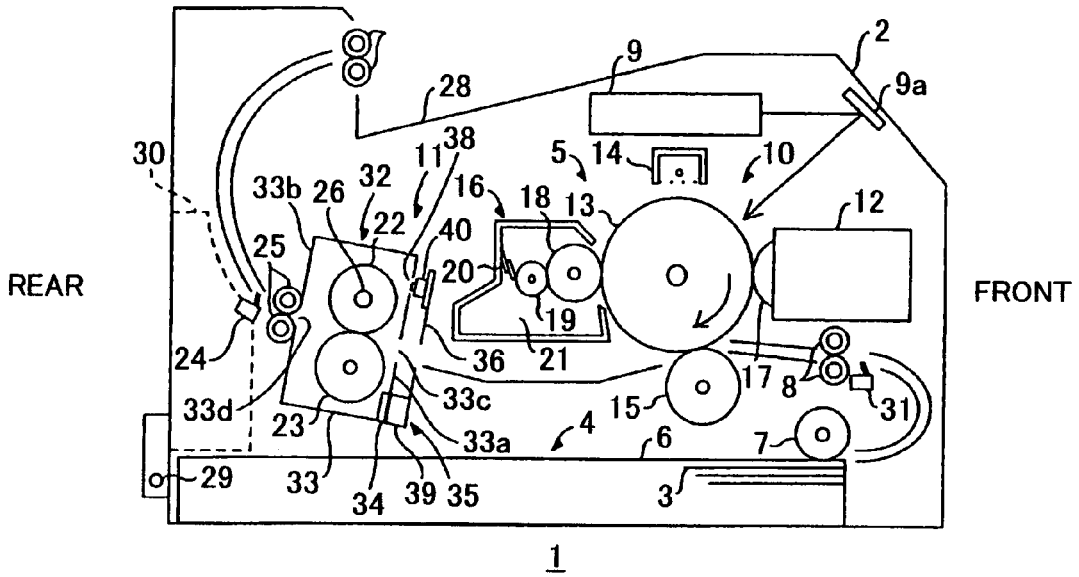
FIG. 1 is a schematic side view showing an internal arrangement of a laser printer according to a first embodiment of the present invention, and showing a state in which a thermal fixing unit is assembled in a main casing while closing a rear cover.

In FIG. 1, a laser printer 1 includes a main casing 2 in which a feeder unit 4 for supplying a sheet 3 and an image forming unit 5 for forming image on the sheet 3 are disposed. The feeder unit 4 includes a sheet supply tray 6, a sheet supply roller 7, a register roller 8 and a register sensor 31. The sheet supply tray 6 is detachably installed at a bottom of the main casing 2. The sheet supply roller 7 is disposed above an outlet end of the sheet supply tray 6. The register roller 8 is disposed downstream of the sheet supply roller 7 in a sheet feeding direction. The register sensor 31 is disposed immediately upstream of the register roller 8.

The sheet supply tray 6 accumulates therein a stack of cut sheets 3, and an uppermost sheet 3 of the sheet stack is supplied toward the register roller 8 by the rotation of the sheet supply roller 7. The register roller 8 includes a pair of rollers for adjusting orientation of the sheet and then feeding the sheet to the image forming unit 5. The register sensor 31 has an actuator which is rendered ON upon abutment of a leading edge of the sheet 3, and is rendered OFF in case of non abutment of the leading edge. The ON/OFF signals of the actuator can detect the feeding of the sheet 3.

The image forming unit 5 includes a scanner unit 9, a process device 10, and a thermal fixing device 11. The scanner unit 9 is positioned at an upper area within the main casing 2 and includes a reflection mirror 9*a*, a laser emitting section (not shown), a polygon mirror(not shown), and a plurality of lenses (not shown). Laser beam is emitted based on image data from the laser emitting section and is scanningly irradiated at high speed onto a surface of a photosensitive drum 13 described later of the process device 10 through the polygon mirror, the lenses, and the reflection mirror 9*a*.

The process device 10 is disposed below the scanner unit 9 and includes a developing cartridge 12, the photosensitive drum 13, a scorotoron charger 14, a transfer roller 15 and a drum cleaning section 16. The developing cartridge 12 is detachably mounted on the main casing 2 and includes a developing roller 17, a toner thickness regulation blade (not shown), a toner supply roller(not shown) and a toner container(not shown). A developing bias voltage is applied to the developing roller 17. The photosensitive drum 13 is disposed beside the developing roller 17 in contact therewith, and is rotatable in a direction indicated by an arrow in FIG. 1.

The scorotoron charger 14 is disposed above and spaced away from the photosensitive drum 13 by a predetermined distance. The charger 14 is of a positively charging type and includes a tungsten wire for generating a corona discharge in order to uniformly charge the surface of the photosensitive drum 13 with a positive porosity.

The toner container contains generally spherical polymerization toner as a developing agent. The toner is a non-magnetized single component type toner and is positively chargeable. The toner is supplied to the developing roller 17 upon rotation of the toner supply roller, and a thin toner layer with a uniform thickness can be formed over the surface of the developing roller 17 by the toner thickness regulation blade. On the other hand, the surface of the photosensitive drum 13 is uniformly positively charged by the scorotoron charger 14 in accordance with the rotation of the photosensitive drum 13, and is then, the surface of the photosensitive drum 13 is exposed to scanning laser beam from the scanner unit 9, so that an electrostatic latent image can be formed on the surface of the photosensitive drum 13 based on the image data. An electric potential at the irradiated area with the laser beam becomes lower than that of the remaining area of the surface of the photosensitive drum 13 which has been uniformly positively charged. Then, by the rotation of the developing roller 17, a visible toner image is formed on the photosensitive drum 13 corresponding to the electrostatic latent image.

The transfer roller 15 is rotatably disposed immediately below the photosensitive drum 13. The transfer roller 15 is driven by the rotation of the photosensitive drum 13, and is applied with a transfer bias during transfer of the toner image from the photosensitive drum 13 to the sheet 3 when the sheet 3 passes between the photosensitive drum 13 and the transfer roller 15.

The drum cleaning section 16 is positioned downstream of the transfer roller 15 and upstream of the scorotoron charger 14 in the rotational direction of the photosensitive drum 13. The drum cleaning section 16 includes a drum cleaning roller 18, a secondary cleaning roller 19, a cleaning blade 20 and a waste toner tank 21. The drum cleaning roller 18 is in rolling contact with the photosensitive drum 13, and has an outer peripheral surface region formed with an electrically conductive elastic material. The drum cleaning roller 18 is applied with a bias voltage with respect to the photosensitive drum 13.

The secondary cleaning roller 19 is disposed downstream of the photosensitive drum 13 in the rotational direction of the drum cleaning roller 18, and is in rolling contact with the drum cleaning roller 18 at a position opposite to the photosensitive drum 13 with respect to the drum cleaning roller 18. The secondary cleaning roller 19 is made from a metal, and is applied with a bias voltage with respect to the drum cleaning roller 18.

The cleaning blade 20 is disposed downstream of the drum cleaning roller 18 in the rotational direction of the secondary cleaning roller 19, and is in sliding contact with the secondary cleaning roller 19 at a position opposite to the drum cleaning roller 18 with respect to the secondary cleaning roller 19. The cleaning blade 20 includes a thin plate like scraper blade for scraping off the toner from the surface of the secondary cleaning roller 19.

Toner remaining on the surface of the photosensitive drum 13 after toner transfer onto the sheet 3 is electrically trapped by the drum cleaning roller 18, when the remaining toner is brought into confrontation with the drum cleaning roller 18 by the rotation of the photosensitive drum 13. The trapped toner is then electrically trapped by the secondary cleaning roller 19 when the trapped toner on the drum cleaning roller 18 is brought into confrontation with the secondary cleaning roller 19 by the rotation of the drum cleaning roller 18. Then, the trapped toner on the secondary cleaning roller 19 is scraped off by the cleaning blade 20 and collected into the waste toner tank 21.

The thermal fixing device 11 is positioned beside and downstream of the process device 10, and includes a thermal fixing unit 32 and a temperature sensor unit 35. The thermal fixing unit 32 is provided detachably from the main casing 2, whereas the temperature sensor unit 35 is stationarily disposed in the main casing 2. The thermal fixing unit 32 can be separated from the temperature sensor unit 35. Incidentally, in the following description, a side of the developing cartridge 12, and a side of the thermal fixing device 11 will be referred to as a front side and a rear side, respectively.

The thermal fixing unit 32 is positioned behind the temperature sensor unit 35, and includes a casing 33, a heat roller 22, a pressure roller 23 those disposed in the casing 33, and a pair of transport rollers 25 disposed at an outer rear face of the casing 33.

Figure 3:
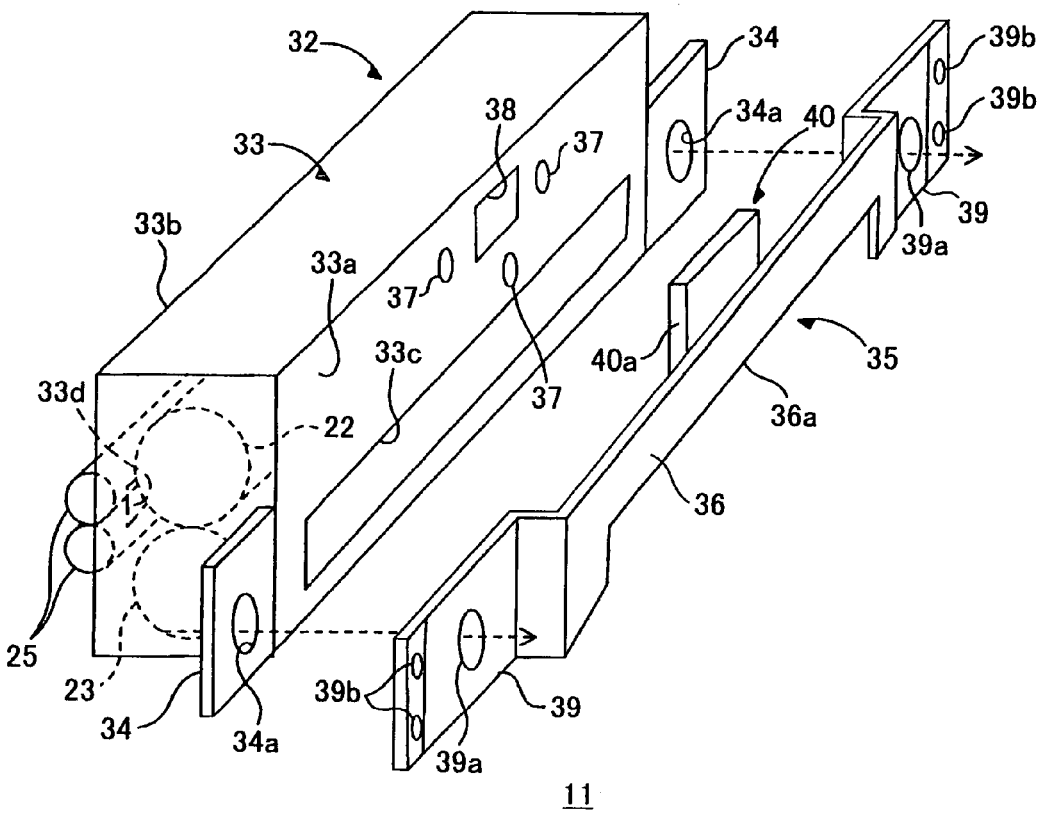
FIG. 3 is a schematic perspective view showing essential portions of the thermal fixing unit and a temperature sensor unit according to the first embodiment of the present invention.

The casing 33 is of a box shape elongated in a widthwise direction of the sheet 3, i.e., in the direction perpendicular to the sheet feeding direction as shown in FIG. 3. The casing 33 has a front wall 33*a* formed with a rectangular inlet 33*c* extending in the widthwise direction, through which the sheet 3 is introduced into the casing 33. The casing 33 also has a rear wall 33*b* formed with a rectangular outlet 33*d* extending in the widthwise direction through which the sheet is delivered out of the casing 33.

A generally rectangular attachment plate 34 protrudes outwardly from each widthwise end of the front wall 33*a* of the casing 33. Each attachment plate 34 is formed with a generally circular attachment hole 34*a*. Further, a generally rectangular receiving hole 38 is formed at the widthwise center and above the inlet 33*c* in the front wall 33*a* for receiving a temperature sensor 41 described later in the receiving hole 38. The receiving hole 38 is penetrated through the front wall 33*a*. The temperature sensor 41 is one of the elements in a temperature sensing section 40 (FIG. 4) of the temperature sensor unit 35.

Figure 4:
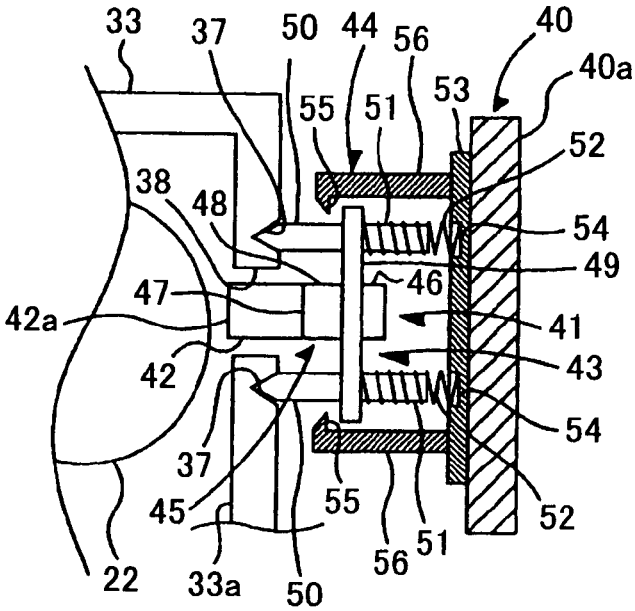
FIG. 4 is a cross-sectional view showing a casing of the thermal fixing unit and a temperature sensing section of the temperature sensor unit according to the first embodiment, and showing a state where the thermal fixing unit is assembled to the main casing.
Figure 5:
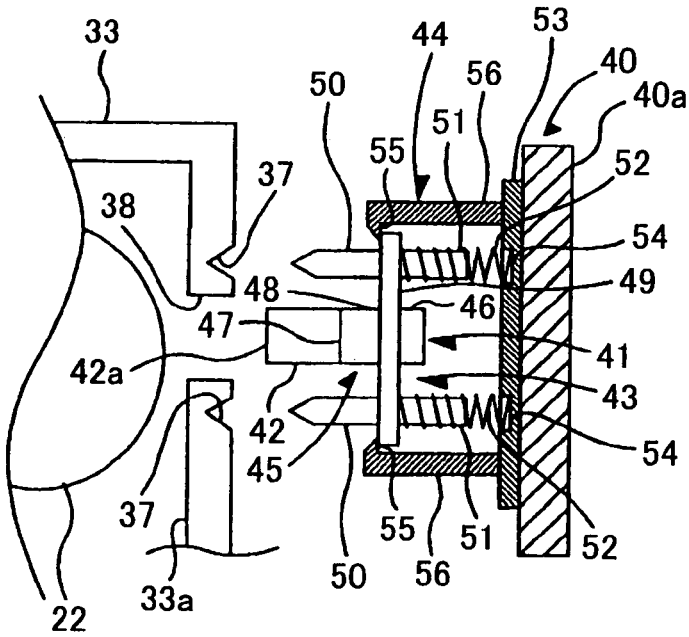
FIG. 5 is a cross-sectional view showing the casing of the thermal fixing unit and the temperature sensing section according to the first embodiment, and showing a state where the thermal fixing unit is detaching from the main casing.

Three positioning recesses 37 are formed around the receiving hole 38 at positions corresponding to corners of an isosceles triangle in the front wall 33*a*. That is, a first recess is positioned at one widthwise side of the receiving hole 38, a second recess is positioned at another widthwise side thereof, and a third recess is positioned below and a center of the receiving hole 38. In other words, the three positioning recesses 37 are not in line. Each positioning recess 37 has a conical shape for receiving therein each positioning pin 50 described later as shown in FIGS. 4 and 5.

The temperature sensor unit 35 has a support plate 36 described later fixed to the main casing 2, and the casing 33 is detachably assembled to the support plate 36. That is, the support plate 36 has fixing plates 39 each formed with an insertion hole 39*a*. Each attachment hole 34*a* of the attachment plate 34 is aligned with each insertion hole 39*a* of each fixing plate 39, and a screw (not shown) is threadingly engaged with each attachment hole 34*a* and the insertion hole 39*a* for detachably fixing the casing 33 to the support plate 36. Thus, the thermal fixing unit 32 is detachably assembled to the main casing 2.

Figure 2:
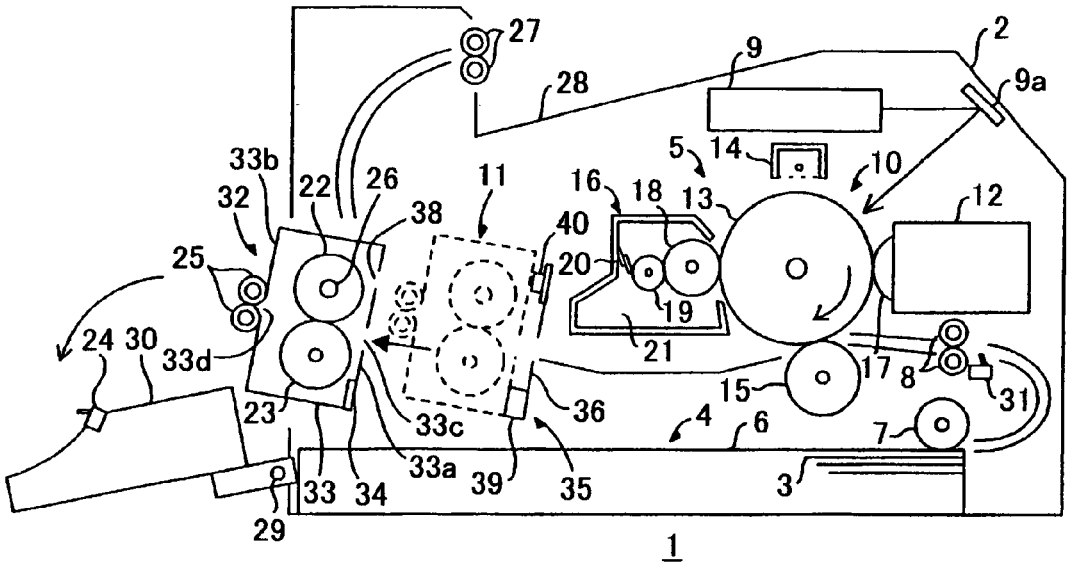
FIG. 2 is a schematic side view showing the internal arrangement of the laser printer according to the embodiment, and showing a state in which the thermal fixing unit is being detached from the main casing while opening the rear cover.

As shown in FIGS. 1 and 2, a rear cover 30 is provided at a rear side of the main casing 2. A hinge 29 is provided at a rear lower side of the main casing 2, and the rear cover 30 is pivotally supported to the main casing 2 through the hinge 29. The rear cover 30 is pivotally movable in a frontward/rearward direction to provide a closed state (FIG. 1) and an open state (FIG. 2). For attaching or detaching the thermal fixing unit 32 to and from the main casing 2, the rear cover 32 is opened. Upon completion of the attachment, the rear cover 32 is closed. An attachment/detachment path is provided between a rear wall of the main casing 2 and the temperature sensor unit 35 for attaching and detaching the thermal fixing unit 32 to and from the temperature sensor unit 35.

FIG. 2 shows a state for detaching the thermal fixing unit 32 from the main casing 2. In this state, the thermal fixing unit 32 is moved rearwardly as indicated by an arrow in FIG. 2. Because the temperature sensor unit 35 is positioned in front of the thermal fixing unit 32, that is, at a side opposite to the attachment/detachment path of the thermal fixing unit 32, no mechanical interference occurs between the temperature sensor unit 35 and the thermal fixing unit 32 during detachment of the thermal fixing unit 32. Thus, the thermal fixing unit 23 can be smoothly detached from the main casing 2 without any damage to the thermal fixing unit 32 and to the temperature sensor unit 35.

The heat roller 22 is disposed in the casing 33 and is made from a metal such as aluminum. The heat roller 22 is formed into a hollow cylindrical shape by drawing. The heat roller 22 accommodates therein a heater 26 such as a halogen heater extending in an axial direction of the heat roller 22. The heater 26 releases heat upon power supply from a power source (not shown) for heating the heat roller 22. More specifically, the heater 26 is subjected to ON/OFF control from a CPU (not shown) in accordance with the detection of a temperature at a surface of the heat roller 22 by a temperature sensor 41 described later, thereby maintaining the surface of the heat roller 22 at a predetermined thermal fixing temperature.

The pressure roller 23 is also disposed in the casing 33 and is positioned immediately below the heat roller 22 interposing therebetween a sheet convey path. The pressure roller 23 includes a metal roller shaft and an elastic roller portion formed thereover in pressure contact with the heat roller 22. The transport roller 25 is supported at a rear wall of the casing 33, and includes a pair of rollers arrayed vertically and positioned at the outlet 33*d*.

A discharge roller 27 is disposed downstream of the transport roller 25, and a discharge tray 28 is provided at an uppermost portion of the main casing 2. Further, a sheet discharge sensor 24 is disposed at the rear cover 30 and is positioned adjacent to and downstream of the transport roller 25. The sheet discharge sensor 24 has an actuator rendered ON upon abutment of the sheet 3 and rendered OFF when the sheet does not abut the actuator in order to detect the discharge of the sheet 3.

The toner image carrying sheet 3 is conveyed from the process device 10 into the inlet 33*c*. Then, the toner image is thermally fixed to the sheet 3, while the sheet 3 is pressedly and heatedly nipped between the heat roller 22 and the pressure roller 23. The sheet then passes through the outlet 33*d* and is discharged onto the discharge tray 28 through the transport roller 25 and the discharge roller 27.

The temperature sensor unit 35 is disposed in front of the thermal fixing unit 32, and includes the temperature sensing section 40 and the support plate 36 for supporting the temperature sensing section 40 to the main casing 2. The support plate 36 is of an elongated plate shape extending in the widthwise direction of the sheet 3. The support plate 36 has a lower portion formed with an inverted U-shaped opening 36*a* for allowing the sheet 3 to pass therethrough. As described previously, each fixing plate 39 is provided at each widthwise end of the support plate 36. The generally circular insertion hole 39*a* is formed at a center portion of each fixing plate 39. Further, two fixing holes 39*b* are formed at widthwise outer side of each insertion hole 39*a*. Each fixing plate 39 is positioned rearwardly of the support plate 36 to provide a stepped portion, so that each attachment plate 34 of the casing 33 can be easily abutted against each fixing plate 39.

Screws (not shown) are inserted through the respective fixing holes 39*b* for fixing the fixing plates 39 to the main casing 2. Thus, the support plate 36 is fixed to the main casing 2, i.e., the temperature sensor unit 35 is fixed to the main casing 2. As described above, because the casing 33 of the thermal fixing unit 32 is detachably fixed to the support plate 36, the thermal fixing unit 32 can be detachably fixed to the temperature sensor unit 35 and to the main casing 2. The support plate 36 is positioned in front of the casing 33, so that the toner image carrying sheet 3 will be introduced into the inlet 33*c* of the casing 33 after the sheet 3 has passed through the inverted U-shaped opening 36*a*. Incidentally, the temperature sensor unit 35 can be detached from the main casing 2 by releasing the screws extending through the fixing holes 39*b* from the main casing 2.

As shown in FIG. 3, the temperature sensing section 40 is provided on a temperature sensing plate 40*a* having a rectangular shape and positioned at the widthwise center and an upper portion of the support plate 36. As shown in FIG. 4, the temperature sensing section 40 includes the temperature sensor 41, a sensor holder 43 for holding the temperature sensor 41, and a sensor casing 44 for resiliently supporting the sensor holder 43.

The temperature sensor 41 includes a light receiving portion 45 for detecting an infrared radiation released from an outer peripheral surface of the heat roller 22, and a conduit 42 for introducing the infrared radiation into the light receiving portion 45. The light receiving portion 45 is provided by a non-contact type infrared radiation sensor positioned spaced away from the outer peripheral surface of the heat roller 22 in a non-contacting fashion in order to detect a surface temperature of the heat roller 22. The infrared radiation sensor 45 is of a thermoelectromotive force type thermopile where a thermopile element, which is an integrated thermocouple is used.

To be more specific, the light receiving portion 45 includes a can case 48 which receives infrared radiation released from the outer peripheral surface of the heat roller 22, and the thermopile elements 46 that detects infrared radiation received by the can case 48. The can case 48 has a cylindrical shape and has a detection window 47 through which an incident infrared ray passes. The detection window 47 is provided at an end of the can case 48 and has a rectangular shape with a predetermined area capable of providing a predetermined angle of field of view to detect the infrared radiation. Further, the detection window 47 is provided with an optical filter that allows specific infrared radiation having wavelength of not less than 5 μm to transmit therethrough. That is, the infrared radiation having wavelength of less than 5 μm is absorbed by a water vapor. Therefore, the filter prevents the infrared radiation having wavelength of less than 5 μm from being transmitted therethrough in order to avoid degradation of the detection accuracy dependent on variation in amount of infrared radiation due to variation in amount of water vapor. The thermopile element 46 has a rectangular shape and positioned at opposite end of the can case 48 in confronting relation to the detection window 47.

Incidentally, the angle of field of view is a view angle capable of providing 50% sensitivity with respect to a detection sensitivity by the thermopile element 46 when an object to be detected is disposed in front of the thermopile element 46 through the detection window 47. For example, the angle of field of view of ±26° or ±60° is available in the light receiving portion 45.

The conduit 42 is in a hollow cylindrical shape and insertable into the receiving hole 38 of the casing 33. The conduit 42 has a metallic inner peripheral surface serving as a reflection surface for reflecting infrared radiation. When the thermal fixing unit 32 is assembled to the main casing 2, one open end 42*a* of the conduit 42 is inserted into the receiving hole 38 of the casing 33, while another open end of the conduit 42 is assembled to the detection window 47 of the can case 48 of the light receiving portion 45. The one open end 42*a* is spaced away from the outer peripheral surface of the heat roller 22 by a predetermined distance. The inner reflection surface of the conduit 42 is formed from a metal such as aluminum, silver and gold, those providing reflection rate of the infrared radiation of not less than 80%. Gold is preferable since its reflection rate of the infrared radiation is sufficiently high such as about 98%.

Figure 6:
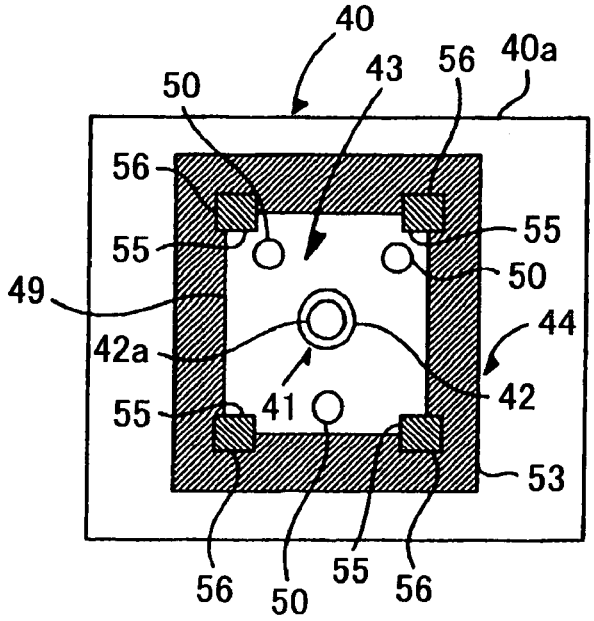
FIG. 6 is a front view showing the temperature sensing section according to the first embodiment.

As shown in FIGS. 4 through 6, the sensor holder 43 includes a generally rectangular base plate 49, three positioning pins 50 and three spring securing projections 51, those integral with each other. The base plate 49 has a central portion where the temperature sensor 41 is insertedly held in a direction perpendicular to the base plate 49, that is, in the attachment/detachment direction of the thermal fixing unit 32.

Each positioning pin 50 extends toward the thermal fixing unit 32 from the base plate 49 and is positioned to be engaged with corresponding recess 37 of the casing 33 when the thermal fixing unit 32 is assembled to the main casing 2. That is, one positioning pin 50 is positioned obliquely above the temperature sensor 41, second positioning pin 50 is positioned oppositely obliquely above the temperature sensor 41, and third positioning pin 50 is positioned vertically below the temperature sensor 41, so that these pins 50 define an imaginary triangle around the temperature sensor 41. Each tip end of each positioning pin 50 is a conical shape for facilitating engagement with the corresponding positioning recess 37. Each spring securing projection 51 protrudes from the base plate 49 in a direction opposite to the protruding direction of each positioning pin 50, and in line therewith.

The sensor casing 44 includes a spring support plate 53 four engaging legs 56, and three compression springs 52. The spring support plate 53 is provided on the temperature sensing plate 40*a*, and has an outer rectangular contour smaller than that of the temperature sensing plate 40*a*. Three recesses 54 serving as spring seats are formed on a surface of the spring support plate 53 at positions corresponding to the spring securing projections 51. Each compression spring 52 has one end disposed over each spring securing projection 51, and another end seated on each spring seat recess 54.

The four engaging legs 56 protrude from the spring support plate 53 toward the thermal fixing unit 32. These engaging legs 56 have length equal to one another, and each engaging leg 56 is positioned in alignment with each corner of the base plate 49 as shown in FIG. 6. Further, each engaging leg 56 has each free end provided with a locking pawl 55 for engagement with each corner portion of the base plate 49. Upon engagement, distances between the spring support plate 53 and each corner portion of the base plate 49 are equal to one another.

Thus, for assembling the temperature sensing section 40, the temperature sensor 41 is fixed to the base plate 49 of the sensor holder 43. Then, the base plate 49 is positioned within the four engaging legs 56 while each one end of each compression spring 52 is disposed over each spring securing projection 51 of the sensor holder 43 and each other end of each compression spring 52 is seated on each recess 54. Because of the biasing force of the compression springs 52, the sensor holder 43 is urged in a direction away from the spring support plate 53, so that each corner portion of the base plate 49 is brought into engagement with each locking pawl 55. Thus, the sensor holder 43 is resiliently supported in the sensor casing 44.

In a case where the thermal fixing unit 32 has been removed from the main casing 2 as shown in FIG. 5, the sensor holder 43 is urged in a direction away from the spring support plate 53 by the biasing force of the compression springs 52, so that each corner portion of the base plate 49 is engaged with each locking pawl 55. In this state, the base plate 49 is resiliently held in the sensor casing 44 and extends in a direction parallel to the spring support plate 53. Thus, the temperature sensor 44 and each positioning pin 50 are directed in the attachment/detachment direction of the thermal fixing unit 32.

For assembling the thermal fixing unit 32 to the main casing 2, the rear cover 30 is opened as shown in FIG. 2, and the thermal fixing unit 32 is inserted frontwardly toward the main casing 2. By the insertion, the temperature sensor 41 fixed at the sensor holder 43 is brought into insertion into the receiving hole 38 of the front wall 33*a* of the casing 33, and as a result, the front open end 42*a* of the conduit 42 is positioned in confrontation with the outer surface of the heat roller 22 by a predetermined distance as shown in FIG. 4.

In this state, as shown in FIG. 4, the each positioning pin 50 of the sensor holder 43 is brought into abutment with each positioning recess 37 formed at the front wall 33*a*. The sensor holder 43 is moved, within the sensor casing 44, toward the spring support plate 53 against the biasing force of the compression springs 52 because of the reaction force from the positioning recess 37. Finally, the sensor holder 43 is stopped at a predetermined posture. Consequently, a posture of the temperature sensor 41 is fixed to thus fix the distance and orientation of the temperature sensor with respect to the heat roller 22.

With this arrangement, relative position between the heat roller 22 and the temperature sensor 41 can be maintained in a constant fashion even after disassembly and assembly of the thermal fixing unit 32 from and to the main casing 2. Because the distance and orientation of the temperature sensor 41 with respect to the heat roller 22 can be accurately provided each time the thermal fixing unit 32 is assembled to the main casing 2, surface temperature of the heat roller 22 can be precisely detected with high repeatability thereby enhancing detection accuracy. This advantage is particularly important for the thermopile type infrared radiation sensor where its light receiving portion 45 is subjected to severe requirements in distance and orientation with respect to the object to be detected.

Further, with this arrangement, relative position between the heat roller 22 and the temperature sensor 41 can be easily fixed by the simple arrangement, i.e., by the engagement between the positioning pins 50 and the positioning recesses 37. Moreover, because the base plate 49 is resiliently supported by the compression springs 52 each corresponding to each positioning pin 50, and because three positioning pins 50 and associated three positioning recesses 37 are not in line, but offset from each other in a triangular fashion, the base plate 49 can be held at a desired orientation upon engagement between the pins and recesses without any rattling. Thus, stabilized positioning of the temperature sensor 41 results.

Then, screws are threadingly inserted through the attachment hole 34*a* of the attachment plate 34 of the casing 33 and through the insertion hole 39*a* of the fixing plate 39 of the support plate 36 fixed to the main casing 2 to fixedly secure the thermal fixing unit 32 to the main casing 2.

After the thermal fixing unit 32 is assembled to the main casing 2, as shown in FIG. 4, the open end 42*a* of the conduit 42 is received in the receiving hole 38 of the casing 33, and relative position between the open end 42*a* and the heat roller 22 can be fixed. The infrared radiation emitted from the surface of the heat roller 22 is directed to the detection window 47 of the light receiving portion 45 through the reflection at the inner peripheral reflection surface of the conduit 42, and is detected by the thermopile element 46. Because the light receiving portion 45 is spaced away from the surface of the heat roller 22 through the interposition of the conduit 42, durability of the light receiving portion 45 can be enhanced. Further, a surface temperature of the heat roller 22 can be detected at high sensitivity because the infrared radiation from the heat roller 22 can be trapped by the open end 42*a* of the conduit 42 and the trapped infrared radiation can reach the light receiving portion 45 as a result of the reflection at the reflection surface of the conduit 42.

Furthermore, because the temperature sensor 41 is composed by the non-contact type infrared radiation sensor positioned spaced away form the surface of the heat roller 22, prolonged service life of the sensor can result with a lesser damage. On the other hand, the heat roller 22 and the pressure roller 23 of the thermal fixing unit 32 will be worn due to mutual pressure contact as a result of long term operation, and must be replaced by new heat roller and new pressure roller. In this case, only the thermal fixing unit 32 can be disassembled from the main casing 2 without disassembly of the temperature sensor unit 35 to save a cost. In this disassembly, the temperature sensor unit 35 is not on the attachment/detachment path of the thermal fixing unit 32. Therefore, no mechanical interference occurs between the temperature senor unit 35 and the thermal fixing unit 32, thereby further prolonging service life of the temperature sensor 41.

Since the temperature sensor unit 35 is fixed to the main casing 2 by screws (not shown) inserted through the fixing holes 39*b*, the temperature sensor unit 35 can be removed from the main casing 2 by unfastening the screws when the temperature sensor 41 must be replaced by a new temperature sensor due to any damage or expiration of span of service life.

Thus, in the laser printer 1, the sheet 3 is nippingly and heatedly conveyed between the pressure roller 23 and the heat roller 22, during which the surface temperature of the heat roller 22 is detected by the temperature sensor 41 so as to perform ON/OFF control to the heater 26 based on the detected temperature in order to maintain a desired fixing temperature.

Figure 7:
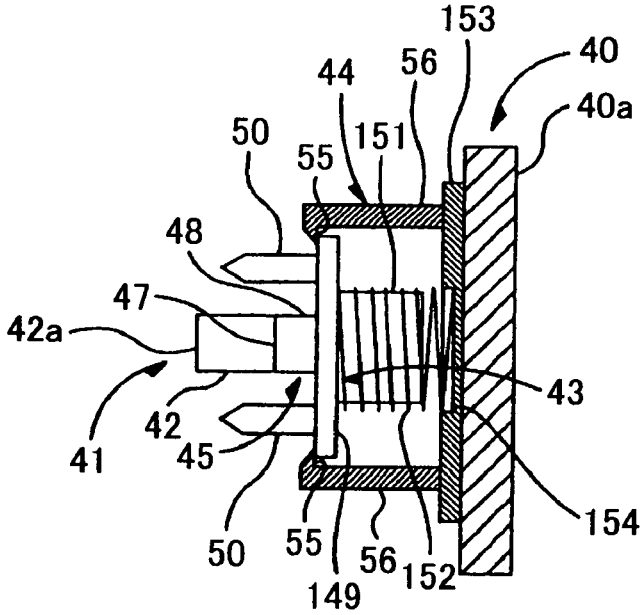
FIG. 7 is a cross-sectional view showing a temperature sensing section according to a second embodiment of the present invention.

A thermal fixing device according to a second embodiment of the present invention will be described with reference to FIG. 7 wherein like parts and components are designated by the same reference numerals as those shown in the first embodiment. In the first embodiment three spring securing portions 51 protrude from the base plate 49 and three compression springs 52 and three spring seats 54 are provided. On the other hand, in the second embodiment, only one spring securing portion 151 having a diameter greater than that of the spring securing portions 51 protrudes from a center portion of a base plate 149. Further a spring support plate 153 is formed with a single spring seat 154 and a single compression spring 152 is interposed between the spring seat 154 and the single spring securing portion 151. With this arrangement, the sensor holder 43 can be resiliently supported in a manner similar to that of the first embodiment.

Figure 8:
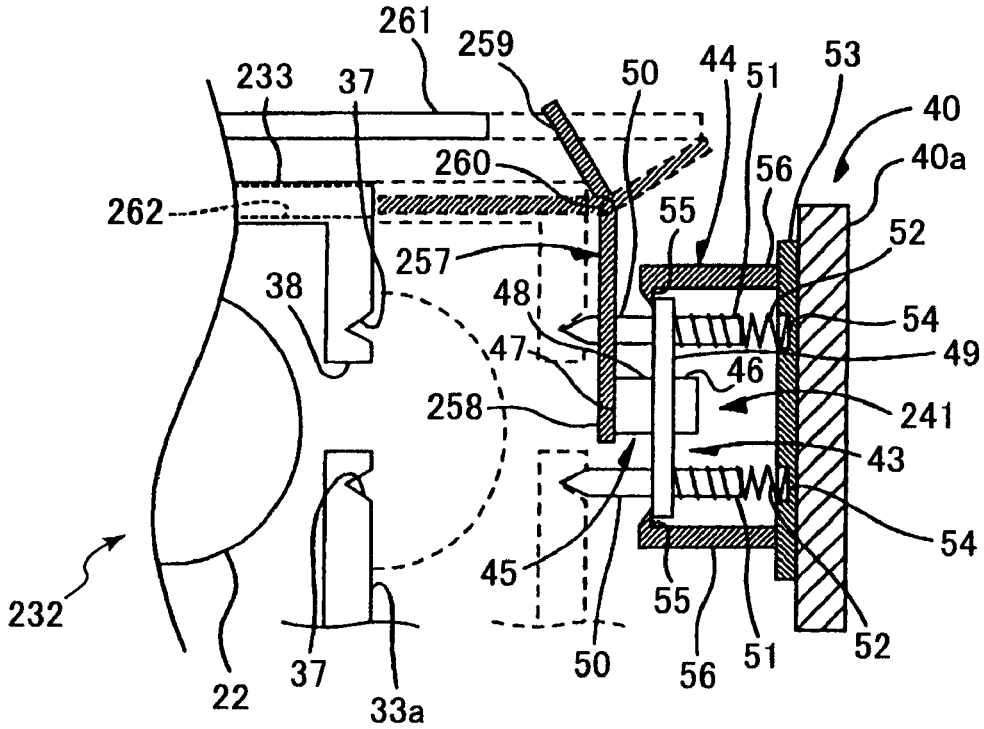
FIG. 8 is a cross-sectional view showing a temperature sensing section according to a third embodiment of the present invention.

FIG. 8 shows a thermal fixing device according to a third embodiment. A temperature sensor 241 does not provide a conduit 42 of the foregoing embodiments, and a sensor cover 257 is pivotally supported to the main casing 2 by a pivot shaft 260 for closing the detection window 47 of the light receiving portion 45 when the thermal fixing unit 232 is moved away from the temperature sensor 241.

More specifically, the sensor cover 257 is in a bent shape having a major arm section 258 adapted for covering the detection window 47 and an abutment arm section 259 integral with the major arm section 258. The major arm section 258 is directed vertically because of its gravity when the major arm 258 completely covers the detection window 47. A casing 233 has an outer arm 261 whose free end is abuttable onto a free end of the arm section 259 when the thermal fixing unit 232 is assembled to the main casing 2. The casing 233 is formed with an elongated hole 262 opened at its front end face for receiving therein the major arm section 258 when the sensor cover 257 is pivotally moved by the forward movement of the outer arm 261.

When the casing 233 is moved away from the temperature sensor 241 as the thermal fixing unit 232 is removed from the main casing 2, the major arm section 258 of the sensor cover 257 is suspended vertically downwardly because of its gravity so that the major arm section 258 covers the detection window 47 as shown by a solid line in FIG. 8. As a result, the detection window 47 is protected against dirt and damage during replacement of the thermal fixing unit 232. Thus, the temperature sensor 241 can perform accurate temperature detection for a long duration.

In assembly of the thermal fixing unit 232 to the main casing 2, the outer arm 261 of the casing 233 pushes the free end portion of the abutment arm section 259 frontwardly as shown by a broken line in FIG. 8, so that the major arm section 258 is pivotally moved in a clockwise direction in FIG. 8 about the pivot shaft 260. As a result, the major arm section 258 is gradually directed horizontally and is inserted into the elongated hole 262 thereby opening the detection window 47 capable of confronting the heat roller 22.

Figure 9:
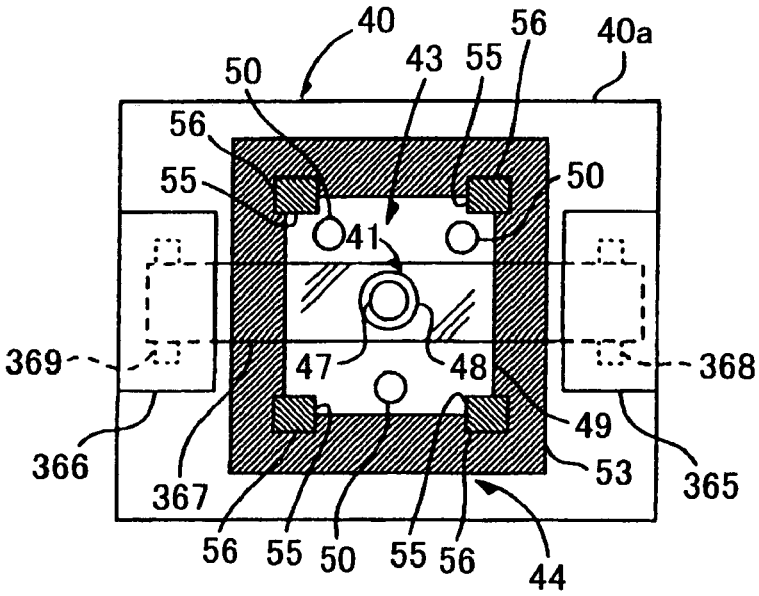
FIG. 9 is a front view showing a temperature sensing section according to a fourth embodiment of the present invention.

FIG. 9 shows a thermal fixing device according to a fourth embodiment which is a modification to the third embodiment. The fourth embodiment employs a protection film 367 instead of the sensor cover 257 of the third embodiment for protecting the detection window 47. More specifically, a film feed section 365 for feeding the protection film 367 is provided on a temperature sensing plate 340*a* and at one side of the temperature sensor 41, and a film take-up section 366 for taking up the film 367 is provided on the temperature sensing plate 340*a* and at another side of the temperature sensor 41. Thus, the protection film 367 is bridged over the detection window 47 and between the film feed section 365 and the film take-up section 366. The protection film 367 is made from a transparent material such as polyimide which transmits infrared radiation therethrough.

In the film feed section 365, a film feed reel 368 winding thereover a new elongated film is rotatably provided for unwinding the new film 367. In the take-up section 366, a film take-up reel 69 is rotatably provided for taking-up the used film 367. The take-up reel 369 is rotatable by a predetermined numbers by a drive motor (not shown). The film 367 is always bridged over the detection window 47. The drive motor is temporarily rotated at a predetermined timing, for example, at the time of replacement of the thermal fixing unit, so that a new area of the film 367 can be positioned over the detection window 47 as a result of the predetermined number of rotation of the take-up reel 369. Thus, the detection window 47 can be protected for a long duration, to provide accurate temperature detection for the duration.

While the invention has been described in detail with reference to specific embodiments thereof, it would be apparent to those skilled in the art that various changes and modifications may be made therein without departing from the spirit and scope of the invention.

For example, in the foregoing embodiments, the temperature sensors detect the surface temperature of the heat roller 22. However, surface temperature of the pressure roller 23 can be detected instead of the detection of the surface temperature of the heat roller, because these temperatures are closely related to each other as a result of nipping contact with each other.

Further, in the foregoing embodiments, positioning recesses are formed in the casing of the thermal fixing unit, and positioning pins engageable with these recesses are provided at the temperature sensor unit. However, these recesses can be formed in the temperature sensor unit, and these pins can be provided at the thermal fixing unit. Furthermore, numbers and positions of these pins and recesses are not limited to the foregoing embodiments, but can be modified depending upon intended orientation and use.

Further, in the foregoing embodiments, the non-contact type infrared radiation sensor is used which is out of contact from the surface of the heat roller. However, a contact type temperature sensor such as a thermistor is also available.

What is claimed is:

1. An image forming device comprising:

a main casing; and a thermal fixing device comprising a thermal fixing unit that heatingly fixes a visible image onto an image recording medium, the thermal fixing unit comprising a fixing unit casing, and a heating component disposed in the fixing unit casing, and a temperature sensor unit that detects a temperature of the thermal fixing unit, and comprising a temperature sensor, and a support member supporting the temperature sensor and fixed to the main casing, the fixing unit casing being detachably fixed to the support member, whereby the temperature sensor unit is mounted to the main casing, the temperature sensor being out of contact from the heating component when the fixing unit casing is fixed to the support member.

2. The image forming device as claimed in claim 1, wherein the thermal fixing unit is detachably mounted to the temperature sensor unit.

3. The image forming device as claimed in claim 1, wherein the main casing defines therein an attachment/detachment path for the thermal fixing unit, the temperature sensor unit being mounted to the main casing at a position offset from the attachment/detachment path.

4. The image forming device as claimed in claim 3, wherein the temperature sensor unit is positioned in front of the attachment/detachment path of the thermal fixing unit.

5. The image forming device as claimed in claim 4, wherein the temperature sensor unit has a detection window opened to a rear side of the temperature sensor unit; and wherein the fixing unit casing is formed with a receiving hole through which the temperature sensor is positioned.

6. The image forming device as claimed in claim 1, wherein the temperature sensor unit is detachable from the main casing.

7. The image forming device as claimed in claim 1, wherein the thermal fixing device further comprising a positioning section for positioning the temperature sensor with respect to the thermal fixing unit.

8. The image forming device as claimed in claim 7, wherein the positioning section comprises a positioning pin protruding from one of the temperature sensor unit and the thermal fixing unit, and a positioning recess engageable with the positioning pin and formed at remaining one of the thermal fixing unit and the temperature sensor unit.

9. The image forming device as claimed in claim 8, wherein the positioning section further comprises a biasing member that bias one of the positioning pin and the positioning recess toward remaining one of the corresponding positioning recess and the positioning pin.

10. The image forming device as claimed in claim 8, wherein the positioning pin comprises three positioning pins arrayed offset from each other, and wherein the positioning recess comprises associated three positioning recesses arrayed offset from each other, and positioning recess being engaged with each associated positioning pin.

11. The image forming device as claimed in claim 8, wherein the temperature sensor comprises a non-contact type temperature sensor.

12. The image forming device as claimed in claim 11, wherein the non-contact type temperature sensor comprises a thermopile.

13. The image forming device as claimed in claim 1, wherein the thermal fixing unit further comprises a pressure component in pressure contact with the heating component, the temperature sensor unit detecting a surface temperature of the heating component.

14. The image forming device as claimed in claim 1, wherein the temperature sensor has a detection window, and wherein the thermal fixing device further comprises a protecting section for covering the detection window when the thermal fixing unit is detached from the temperature sensor unit.

15. The image forming device as claimed in claim 1, wherein the temperature sensor has a detection window, and wherein the thermal fixing device further comprises a protective film positioned to cover the detection window.

16. The image forming device as claimed in claim 7, wherein the temperature sensor unit further comprises a stationary section mounted on the main frame, the positioning section being supported to the stationary section and movable with respect to the stationary section in accordance with an abutment with the thermal fixing unit, a position of the temperature sensor being fixed upon abutment of the positioning section with the thermal fixing unit.

17. The image forming device as claimed in claim 16, wherein the positioning section comprises:

a base plate movable with respect to the stationary section;

a positioning pin protruding from one of the base plate and the fixing unit casing; and a positioning recess engageable with the positioning pin and formed at remaining one of the fixing unit casing and the base plate.

18. The image forming device as claimed in claim 17, wherein the positioning pin comprises three positioning pins protruding from the base plate, and the positioning recess comprises three positioning recesses formed at the fixing unit casing, positioning pins having protruding length equal to each other.

19. The image forming device as claimed in claim 18, wherein the stationary section comprises:

the support plate detachably fixed to the main casing;

a temperature sensing plate fixed to the support plate; and engagement legs extending from the temperature sensing plate, each engagement legs having a free end provided with a locking pawl engageable with the base plate;

and wherein the positioning section further comprises:

three spring securing portions protruding from the base plate and each extending in line with each positioning pin and protruding in a direction opposite to each positioning pin; and three biasing spring interposed between each spring securing portion and the stationary section for urging the base plate toward the locking pawl.

20. A thermal fixing device comprising:

a thermal fixing unit that heatingly fixes a visible image onto an image recording medium, the thermal fixing unit comprising a fixing unit casing, and a heating component disposed in the fixing unit casing; and a temperature sensor unit that detects a temperature of the thermal fixing unit, the thermal fixing unit being detachably mounted to the temperature sensor unit;

the temperature sensor unit comprising a temperature sensor, and a support member supporting the temperature sensor and fixable to a frame of an image forming device, the fixing unit casing being detachably fixed to the support member, whereby the temperature sensor unit is mountable to the frame, the temperature sensor being out of contact from the heating component when the fixing unit casing is fixed to the support member.

21. The thermal fixing device as claimed in claim 20, wherein the thermal fixing unit is attached to and detached from the temperature sensor unit in an attachment/detachment direction;

wherein the temperature sensor has a detection window open toward the attachment detachment direction; and wherein the fixing unit casing is formed with a receiving hole through which the temperature sensor is positioned.

22. The thermal fixing device as claimed in claim 20, wherein the thermal fixing unit is attached to and detached from the temperature sensor unit in an attachment/detachment direction; and wherein the thermal fixing device further comprising a positioning section for positioning the temperature sensor with respect to the thermal fixing unit.

23. The thermal fixing device as claimed in claim 22, wherein the positioning section comprises a positioning pin protruding from one of the temperature sensor unit and the thermal fixing unit, and a positioning recess engageable with the positioning pin and formed at remaining one of the thermal fixing unit and the temperature sensor unit.

24. The thermal fixing device as claimed in claim 23, wherein the positioning section further comprises a biasing member that bias one of the positioning pin and the positioning recess toward remaining one of the corresponding positioning recess and the positioning pin.

25. The thermal fixing device as claimed in claim 23, wherein the positioning pin comprises three positioning pins arrayed offset from each other, and wherein the positioning recess comprises associated three positioning recesses arrayed offset from each other, each positioning recess being engaged with each associated positioning pin.

26. The thermal fixing device as claimed in claim 23, wherein the temperature sensor comprises a non-contact type temperature sensor.

27. The thermal fixing device as claimed in claim 26, wherein the non-contact type temperature sensor comprises a thermopile.

28. The thermal fixing device as claimed in claim 20, wherein the thermal fixing unit further comprises a pressure component in pressure contact with the heating component, the temperature sensor unit detecting a surface temperature of the heating component.

29. The thermal fixing device as claimed in claim 20, wherein the temperature sensor has a detection window, and the device further comprising a protecting section for covering the detection window when the thermal fixing unit is detached from the temperature sensor unit.

30. The thermal fixing device as claimed in claim 20, wherein the temperature sensor has a detection window, and the device further comprising a protective film positioned to cover the detection window.

31. A thermal fixing device comprising a thermal fixing unit that heatingly fixes a visible image onto an image recording medium; and a temperature sensor unit that detects a temperature of the thermal fixing unit and comprising a non-contact type temperature sensor having a detection window in confrontation with the thermal fixing unit, the thermal fixing unit being detachably mounted to the temperature sensor unit; and a protection section covering the detection window at least when the thermal fixing unit is detached from the temperature sensor unit.

32. The thermal fixing device as claimed in claim 31, wherein the protection section comprises a sensor cover supported to a main casing of an image forming device for closing the detection window when the thermal fixing unit is moved away from the temperature sensor unit.

33. The thermal fixing device as claimed in claim 32, wherein the sensor cover is in a bent shape having a major arm section for covering the detection window and an abutment arm section integral with the major arm section, and wherein the thermal fixing unit is provided with a casing having an arm abuttable on the arm section when the thermal fixing unit is assembled to the main casing for moving the major arm section away from the detection window.

34. The thermal fixing device as claimed in claim 31, wherein the protection section comprises:

a film feed section provided on the temperature sensor unit and positioned at one side of the detection window for feeding a transparent protective film; and a film take-up section provided on the temperature sensor unit for taking up the transparent protective film and positioned at opposite side of the detection window, so that the protection film is bridged over the detection window and between the film feed section and the film take-up section.

* * * * *